US006432027B1

(12) United States Patent
Haselrig

(10) Patent No.: US 6,432,027 B1
(45) Date of Patent: Aug. 13, 2002

(54) MARTIAL ARTS TRAINING BAG

(76) Inventor: Donald A. Haselrig, 6123 St. Marie St., Pittsburgh, PA (US) 15206

( * ) Notice: Subject to any disclaimer, the term of this patent is extended or adjusted under 35 U.S.C. 154(b) by 0 days.

(21) Appl. No.: 09/520,105

(22) Filed: Mar. 7, 2000

Related U.S. Application Data

(60) Provisional application No. 60/123,386, filed on Mar. 8, 1999.

(51) Int. Cl.[7] ..... A63B 69/34
(52) U.S. Cl. ..... 482/83; 482/87; 482/90
(58) Field of Search ..... 482/83–90

(56) References Cited

U.S. PATENT DOCUMENTS 2,237,599 A * 4/1941 Gilman ..... 482/83
D169,243 S * 4/1953 Doherty ..... 482/83
4,557,477 A * 12/1985 Clements et al. ..... 482/83
5,183,450 A * 2/1993 Stelmach ..... 482/83
5,280,905 A * 1/1994 Micco ..... 482/83
5,624,358 A * 4/1997 Hestilow ..... 482/83
5,800,319 A * 9/1998 Choate ..... 482/83
5,899,835 A * 5/1999 Purunda ..... 482/90
6,063,011 A * 5/2000 Pelchat ..... 482/83

FOREIGN PATENT DOCUMENTS

WO WO 94/28981 * 6/1993 ..... 482/83

* cited by examiner

*Primary Examiner*—Jerome W. Donnelly
(74) *Attorney, Agent, or Firm*—Webb Ziesenheim Logsdon Orkin & Hanson, P.C.

(57) ABSTRACT

A martial arts training bag is provided having a substantially cylindrical upper portion and a tapered, e.g., frusto-conical, lower portion. The bag preferably includes one or more head targets and one or more arms extending from the bag. The bag may also include a lance device, a striking ring, a kick post, a leg parry device and/or a high kick device.

19 Claims, 3 Drawing Sheets

MARTIAL ARTS TRAINING BAG

CROSS-REFERENCE TO RELATED APPLICATIONS

This application claims the benefits of U.S. Application Ser. No. 60/123,386, filed Mar. 8, 1999, which is herein incorporated by reference.

BACKGROUND OF THE INVENTION

1. Field of the Invention

This invention relates generally to exercise equipment and, more particularly, to a punching and kicking bag particularly adapted for use by martial arts practitioners.

2. Description of the Available Technology

Punching bags or "heavy bags" are well known for general fitness training or boxing. Conventional punching bags are generally cylindrical in shape having a canvas cover filled with stuffing material. These bags are generally hung from the ceiling and used for punching or kicking exercises. However, such conventional punching bags are not well adapted for martial arts training. Typically, such conventional bags are machine stuffed and therefore are too hard for simulating realistic punching or kicking exercises. Additionally, such cylindrically shaped bags are not representative of typical human body angles and, therefore, do not allow for realistic punching and kicking exercises. Further, conventional bags are not well adapted for ground fighting techniques, since they are typically hung well above the floor. Also, such conventional bags are not well suited to practice trapping and blocking exercises or simulated weapons attacks. Additionally, conventional bags are not well adapted for practicing the different fighting stances and attack styles found in different martial arts systems.

Attempts have been made to overcome some of the limitations of conventional punching bags. For example, water core bags have been developed which present a more realistic feel when struck. However, such water core bags do not overcome the limitations of poor striking angles and poor trapping and blocking training inherent in conventional bags.

Therefore, it would be advantageous to provide a martial arts training bag having improved kicking and punching angles and also a realistic feel when struck. It would also be advantageous if such a martial arts training bag could be used for different fighting techniques, such as long range, short range and ground fighting techniques, and also for use by practitioners at different skill levels and with different body types. It would further be advantageous to provide a martial arts training bag which could be used to practice trapping and blocking exercises and simulated weapons attacks.

SUMMARY OF THE INVENTION

A martial arts training bag is provided having an upper portion and a lower portion. The bag preferably includes a core of material, such as dried bean pebbles, surrounded by a foam liner and an outer covering. The upper portion of the bag may include one or more spaced apart and extensible arms, upper and lower head targets, target spots, a removable high kick device and/or a removable lance device. An annular striking ring generally separates the upper portion of the bag from the lower portion. The lower portion includes a tapered, preferably frusto-conical, region with an extension or post extending downwardly therefrom. A hook, such as a spring hook, is preferably attached to the top of the bag and may be used to hang the bag in conventional manner.

In another embodiment, the martial arts training bag of the invention includes a bag having one or more extensible arms, one or more head targets and may include target spots. A lance assembly may be removably attached to the bag. An annular striking ring generally separates the upper portion of the bag from the lower portion. The lower portion includes a tapered, substantially frusto-conical region carried on a base. The base is preferably hollow and may be filled with ballast material, such as water or sand.

A complete understanding of the invention will be obtained from the following description when taken in connection with the accompanying drawings, wherein like reference characters identify like parts throughout.

DESCRIPTION OF THE PREFERRED EMBODIMENTS

Figure 3:
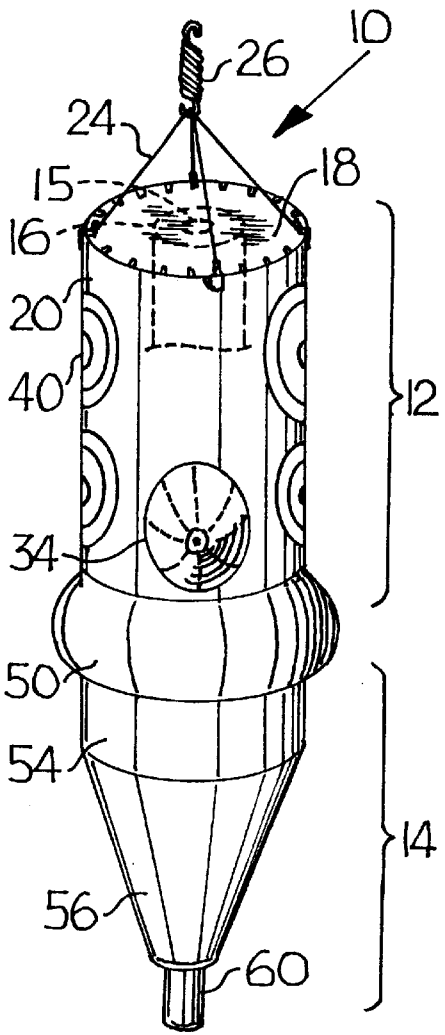
FIG. 3 is a side, elevational view of the bag shown in FIG. 2 rotated 180° to the left.

For purposes of the description hereinafter, the terms "right", "left", "above", "below" and similar spacial terms shall relate to the invention as it is oriented in the drawing figures. However, it is to be understood that the invention may assume various alternative variations and orientations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
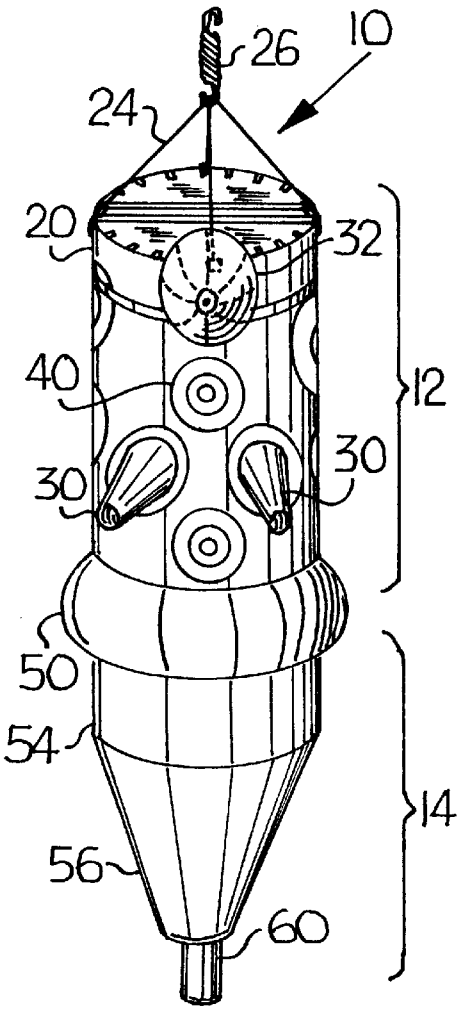
FIG. 2 is a side, elevational view of the bag shown in FIG. 1 rotated 90° to the left.
Figure 1:
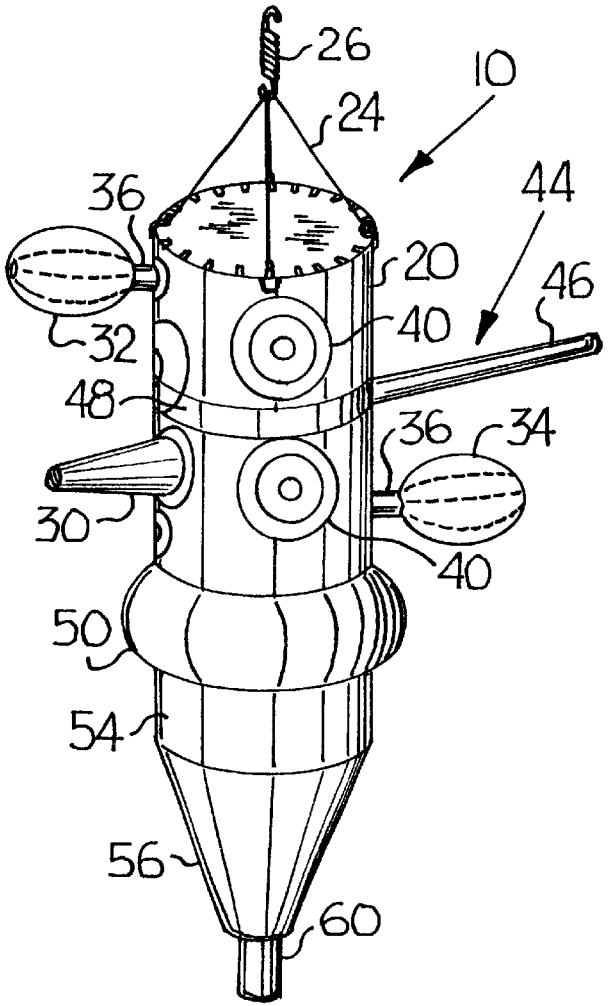
FIG. 1 is a side, elevational view of a first embodiment of a martial arts training bag of the invention.

A first embodiment of a martial arts training bag of the invention is generally designated 10 in FIGS. 1–3. The bag 10 includes a first or upper portion 12 and a second or lower portion 14. As shown by dashed lines in FIG. 3, the bag 10 preferably has a central, preferably rigid, support 15, such as a piece of hollow PVC pipe material, surrounded by a core 16 of dry, hard material, such as dried bean pebbles or similar material, which is in turn surrounded by a foam liner 18 about 1 to about 2.5 inches thick. The core 16 can, alternatively, be fluid filled, such as water filled or can be made of conventional stuffing material. The liner 18 is further surrounded by a substantially water-resistant and tear resistant cover 20, such as leather, canvas or Naugahyde or the like. One or more connectors, such as straps or chains 24, are attached to the top of the bag 10 in conventional manner, such as by stitching, and may also be attached to a mounting device 26, such as a conventional spring hook device, so that the bag 10 can be hung in conventional manner for use.

The upper portion 12 of the bag 10 is substantially cylindrical and includes a pair of spaced apart arms 30 extending outwardly from the side of the bag 10. The arms 30 are preferably tapered and may be telescoping or extensible such that the length of the arms 30 may be adjusted. The arms 30 may be of any suitable material, such as wood, plastic, metal, PVC, etc., and may be surrounded with a removable, padded covering.

The bag 10 also includes a first or upper head target 32 and a second or lower head target 34 extending from the side of the bag 10. Each head target 32, 34 is substantially oval-shaped and is attached to the bag 10 in conventional manner, such as by a post 36. The inner end of each post 36, as well as the inner ends of the arms 30, can be attached to the central support 15 in any convenient manner to provide structural support for the head targets 34 and arms 30. Each head target 32, 34 may be formed from contoured heavy density foam material covered with a suitable material, such as leather, canvas or Naugahyde. Alternatively, each head target 32, 34 may be inflatable, e.g., made of inflatable plastic, or may be made of other suitable stuffing material. Each head target 32, 34 is preferably approximately the size of a typical human head. A plurality of optional target spots 40 may be located on the bag. The target spots 40 preferably correspond in location to designated target areas on the human body.

A lance device 44 may also be attached, preferably removably attached, to the bag 10. The lance device 44 includes an elongated lance 46 formed of conventional material, such as PVC piping, wood, plastic or metal and is preferably covered by a padded sleeve. The lance 46 is carried on an attachment device, such as a belt or strap 48, which may be placed around the bag 10 and held in place in a conventional manner, such as by a conventional locking mechanism, such as a buckle. The lance 46 may be telescoping or may be of a fixed length.

A curved, annular striking ring 50 extends outwardly around the bag 10 near the bottom of the upper portion 12 and generally separates the bag 10 into the upper portion 12 and lower portion 14. The striking ring 50 has a substantially semi-circular cross section and preferably has a core of suitable material, e.g., conventional stuffing materials such as shredded cloth, sawdust, etc., covered by a foam pad or liner and extending transversely (i.e., substantially perpendicularly to a longitudinal axis of the bag 10) or horizontally around the bag 10 under the cover 20. The striking ring 50 may be permanently attached as a permanent part of the bag 10 or, as discussed below with respect to FIG. 4, may be removable.

The lower portion 14 of the bag 10 includes a substantially cylindrical region 54 below the striking ring 50. A tapered region 56 extends downwardly from the cylindrical region 54 and is substantially frusto-conical in shape.

A kick post 60 extends from the bottom of the tapered region 56. The kick post 60 may be made of wood and may be attached to the bottom of the bag 10 in any convenient manner, such as by stitching. The kick post 60 may also be formed by the bottom portion of the support 15 extending beyond the bottom of the bag 10 and may be surrounded by a padded sleeve. Still further, the kick post 60 may be formed from a leather or other such durable cover material surrounding or containing dried bean pebbles or other such stuffing materials.

Figure 4:
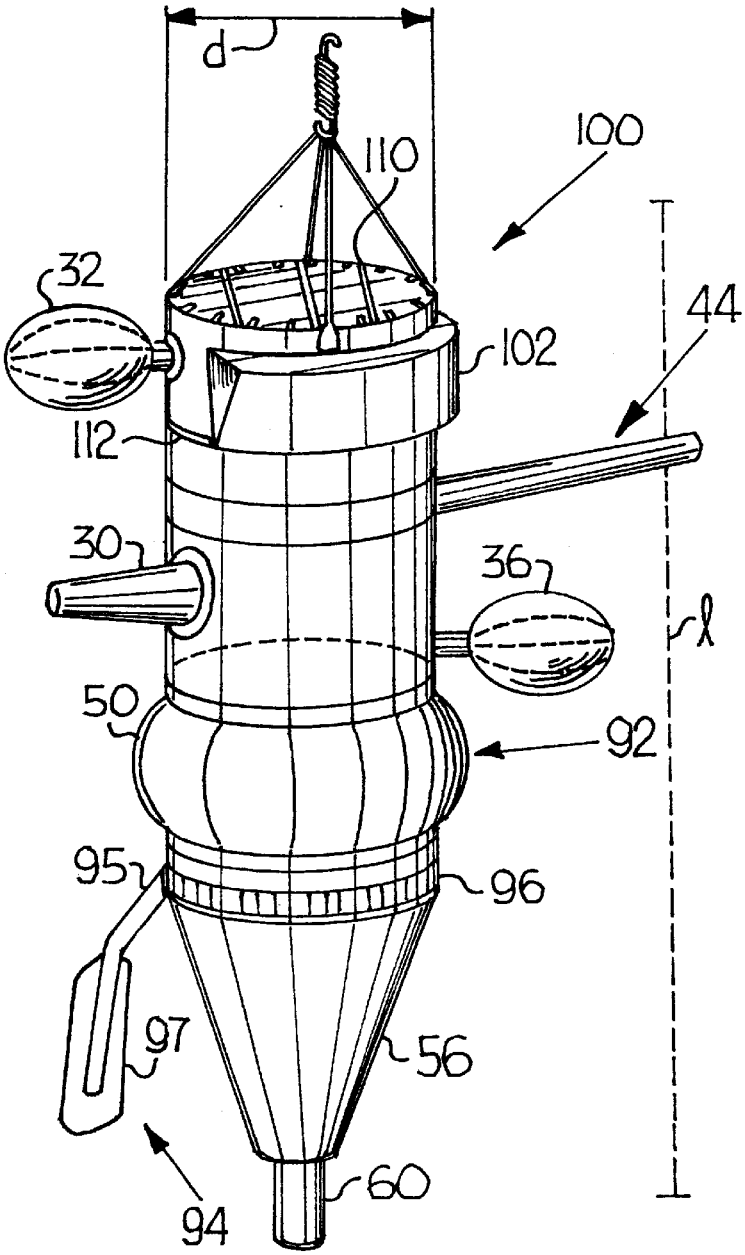
FIG. 4 is a side, elevational view of a further embodiment of the invention similar to that of FIG. l, but including a leg parry device.

A modified bag 90 of the invention is shown in FIG. 4. The bag 90 is similar to the bag 10 shown in FIG. 1 and described above but includes a removable striking ring 92. For example, the striking ring 92 may be formed by a core of stuffing material, such as bean pebbles, cloth, sawdust, etc., surrounded by a covering of water resistant and/or tear resistant material, such as leather, canvas or Naugahyde. The striking ring 92 may be removably held in place by any convenient means, such as by a conventional strap or belt which may be buckled around the bag 90.

A leg parry device 94 may be removably mounted on the bag 90. The leg parry device 94 comprises a support 95 attached to the bag 90, for example by a strap or belt 96. Alternatively, the support 95 may be permanently affixed to the bag 92, such as by being attached to the central support 15. The support 95 preferably comprises a bent, lower portion surrounded by a sleeve of padded material 97. The leg parry device 94 can also be used with the bag 10.

Figure 5:
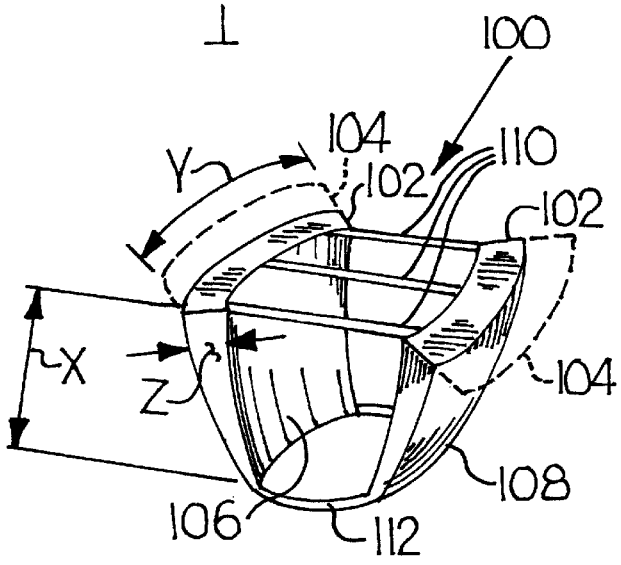
FIG. 5 is a side, elevational view of a high kick device of the invention.

Additionally, as shown in FIGS. 5, 4 and 2, the bag 10, 90 may include a high kick device 100 which may be permanently, or more preferably removably, mounted on the bag 10, 90. As shown in FIG. 5, a removable high kick device 100 includes a plurality of high kick pads 102. The high kick pads 102 are preferably tapered and may be filled with conventional padding or stuffing material as discussed above covered by a wear and/or tear resistant covering. Alternatively, the high kick pads 102 may be formed as hollow pouches having an open top covered by a top flap 104 (shown by dashed lines in FIG. 5) so that a practitioner can fill the high kick pads 102 with any desired material, such as dried bean pebbles. The top flap 104 may be fastenable in any convenient manner, such as by buckles or velcro fasteners. Each high kick pad 102 is preferably tapered, i.e., has a wider top and narrower bottom with an inner surface 106 configured to rest against the bag 10, 90 and an outer surface 108 configured to present a tapered striking surface to the practitioner. The high kick pads 102 are contoured to fit snugly against the bag 10, 90. The high kick pads 102 may be connected by one or more adjustable connecting straps 110 and one or more adjustable holding straps 112. As shown in FIGS. 2 and 4, the high kick device 100 may be slipped over the top of the bag 10, 90 and held in place by tightening the holding straps 112. As shown in FIG. 5, the top or wider part of each high kick pad 102 preferably has a width of about 3 inches to about 4 inches, a length y of about 10 inches to about 14 inches, and a height x of about 5 inches to about 10 inches.

Although not to be considered as limiting, as shown in FIG. 4, a currently preferred embodiment of the bag 90 (and bag 10) has a length 1 of about 64 inches and a diameter d of about 16 inches. The first portion 12 has a length of about 26 inches and the second portion 14 has a length of about 20 inches, with the cylindrical region 54 having a length of about 4 inches and the tapered region 56 having a length of about 16 inches. The kicking post 60 has a length of about 12 inches. The striking ring 92 (or 50) has a length of about 4 inches. The lance 46 has a length of about 3 to about 5 feet and each arm 30 has a length of about 8 to about 20 inches. Each head target assembly has a length of about 36 inches.

Figure 6:
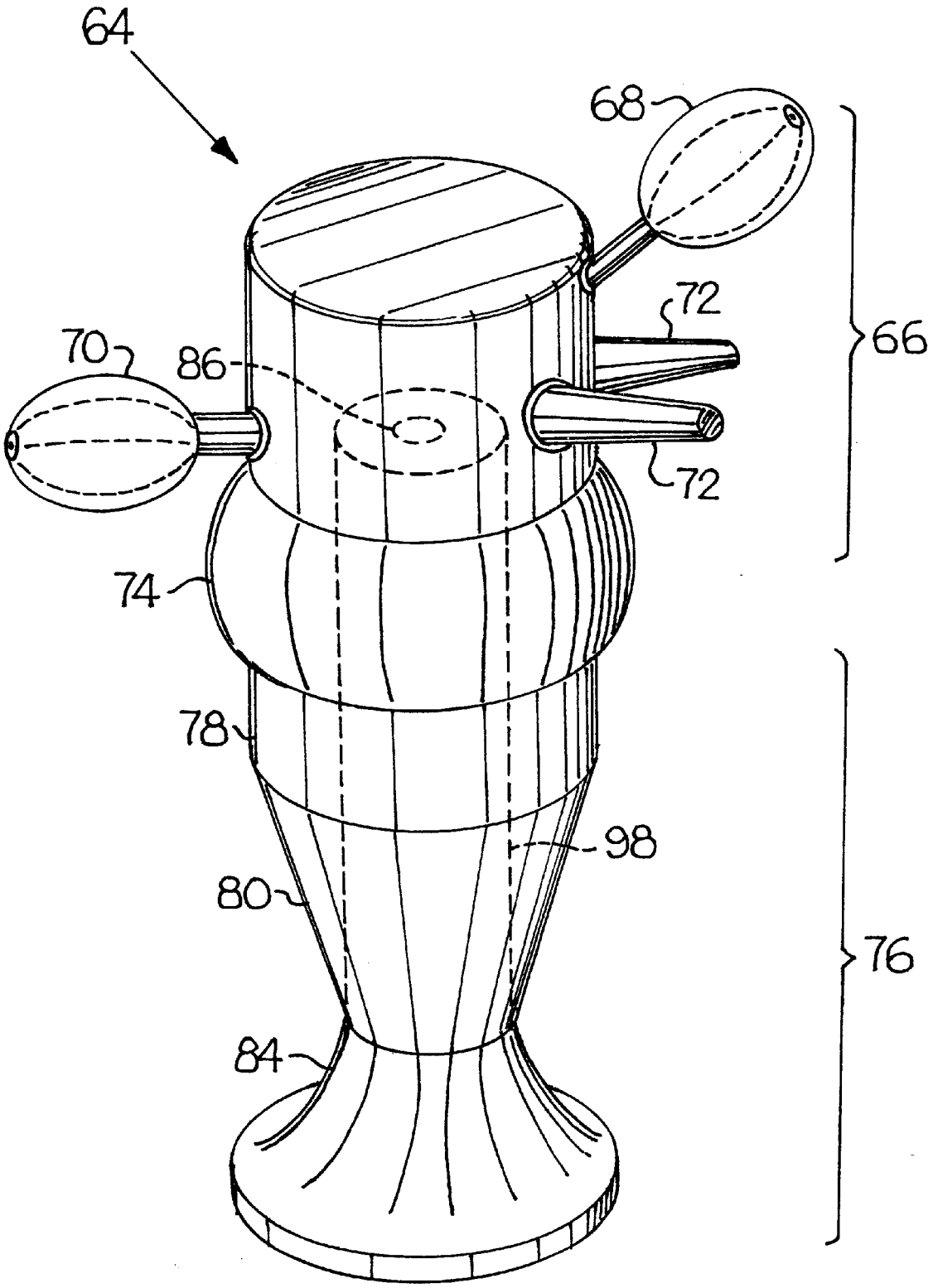
FIG. 6 is a side, elevational view of a second embodiment of a martial arts training bag of the invention.

A second embodiment of the training bag of the invention is generally designated 64 in FIG. 6. The training bag 64 may be shorter than the training bag 10 shown in FIGS. 1–3 and is specifically configured to be placed on a floor rather than being hung like the first training bag 10. The training bag 64 includes an upper portion 66 having an upper head target 68 and lower head target 70, a pair of spaced-apart extensible arms 72, an annular striking ring 74 and may also include a removable lance device (not shown), a high kick device (not shown) and target spots (not shown) similar to the same elements discussed above with respect to the first embodiment of the bag 10 or bag 90.

The bag 64 also includes a lower portion 76 having a substantially cylindrical region 78 and a tapered region 80.

However, in this embodiment, the tapered region 80 is carried on a pedestal or base 84. The base 84 is preferably made of durable material, such as hard plastic, but can also be made of other suitable material, such as metal. The base 84 is preferably hollow and has an opening coverable with a sealing cap 86. Ballast material, such as water or sand, may be placed in the base 84 through the opening to help prevent the bag 64 from toppling over when struck. The bag 64 may have a hollow passage 98 which slips over the upper part of the base 84 to hold the bag 64 upright. The bag 64 may be held in place on the base 84 in any convenient manner, such as by any conventional fastening devices to prevent rotation of the bag 64 on the base 84 when struck.

Operation of the martial arts training bags 10, 90 and 64 of the invention will now be described.

There are many different styles of martial arts, for example, long range arts, such as Korean Tae Kwan Do; long range to intermediate range, such as kicking and punching arts; close range, such as conventional boxing or street fighting techniques; and styles which encompass all of these ranges, such as Indonesian Pentjak Silat. The present invention may be used by a practitioner of any of these styles to practice techniques ranging from long range punching and kicking to close range and ground fighting techniques. Further, the present invention is useful not only for highly skilled practitioners but also is well adapted for novice training. The invention is also easily utilized by students of different body types.

Turning first to the training bag 10 in FIGS. 1–4, the present invention provides many advantages over known punching and striking bags and is particularly well adapted to the martial arts practitioner. For example, the bag 10, 90 has angles and contours that are more realistic of a human target and therefore particularly well adapted for martial arts punching and kicking exercises. The bag 10, 90 is useful not only for stand up techniques but also for ground fighting.

For example, the two arms 30 may be used for trapping or elbow strike techniques and may be extensible to simulate intermediate and close in strikes. The upper and lower head targets 32 and 34 permit the practice of both high kicks and low kicks simulating strikes to the head of an opponent. The high kick device 100 can be used to practice side kicks to the head of an opponent. The target spots 40 may be used to develop accuracy and strength in striking an opponent's body. The removable lance device 44 is particularly well adapted to practice ducking and weaving moves simulating a sword or lance attack by an opponent. The annular striking ring 50 is useful for practicing knee strikes and uppercuts and has contours which more realistically simulate striking a human body than is possible with a conventional punching bag. The tapered region 56 of the lower portion 14 is useful for practicing low kicks and instep kicks. The kick post 60 is also well adapted for practicing instep kicks and for instep conditioning. The leg parry device 94 is useful for low leg parries and stop kicks.

The training bag 64 shown in FIG. 4 may be used generally as described above, with the exception that no kick post 60 is provided. This bag 64 may be particularly useful in ground fighting technique practice or in areas where a training bag is not able to be hung from the ceiling. Additionally, the training bag 64 may be easily transported by opening the cap 86 and removing the ballast from the base 84 to lighten the overall weight of the bag 64 for easier transport.

The training bag 10, 64, 90 discussed above may be provided as a kit with the bag 10, 64, 90 and one or more selected other components, such as the lance device, striking ring, leg parry device and/or high kick device, as desired by a purchaser.

Thus, the present invention provides a significantly improved training bag 10, 64, 90 particularly well adapted for the martial arts practitioner. The kicking and striking targets as well as the angles and contours of the bag 10, 64, 90 itself provide improved striking surfaces over conventional bags.

It will be readily appreciated by those skilled in the art that various modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A training bag, comprising:

a substantially cylindrical upper portion;

a substantially tapered lower portion depending from the upper portion;

at least one connector attached to the upper portion and configured to suspend the bag;

a striking ring extending outwardly from the bag between the upper and lower portions;

a kick post depending from the lower portion;

a first head target extending from the upper portion;

a second head target extending from the upper portion below the first head target; and at least one arm extending from the upper portion between the first and second head targets.

2. The training bag according to claim 1, wherein the tapered portion is substantially frustoconical.

3. The training bag according to claim 1, wherein the bag comprises a rigid central support.

4. A training bag, comprising:

a substantially cylindrical upper portion;

a substantially tapered lower portion depending from the upper portion;

at least one connector attached to the upper portion and configured to suspend the bag;

a striking ring extending outwardly from the bag between the upper and lower portions;

a kick post depending from the lower portion;

a rigid central support; and a core of dry, substantially hard, material surrounding the central support.

5. The training bag according to claim 4, including a foam liner surrounding the core.

6. The training bag according to claim 1, including at least one head target assembly extending from the first portion.

7. The training bag according to claim 1, including at least one arm extending from the first portion.

8. The training bag according to claim 7, wherein the at least one arm is extensible.

9. The training bag according to claim 1, including at least one target spot located on the bag.

10. The training bag according to claim 1, including at least one lance device mounted on the bag.

11. The training bag according to claim 10, wherein the lance device comprises a lance attached to a belt, the belt configured to be removably attached to the bag.

12. The training bag according to claim 1, wherein the striking ring is removably mounted on the bag.

13. The training bag according to claim 1, including a leg parry device mounted on the bag, the leg parry device comprising a support extending at an angle from the bag and a lower padded portion extending at an angle from the support.

14. A training bag, comprising:

a substantially cylindrical upper portion;

a substantially tapered lower portion depending from the upper portion;

at least one connector attached to the upper portion and configured to suspend the bag;

a striking ring extending outwardly from the bag between the upper and lower portions;

a kick post depending from the lower portion; and a high kick device mounted on the upper portion, the high kick device comprising at least one substantially tapered pad surrounding at least a portion of the upper portion of the bag adjacent the top of the upper portion.

15. A training bag, comprising:

a substantially cylindrical first portion;

at least one arm extending from the first portion;

at least one head target extending from the first portion;

a substantially frusto-conical second portion depending from the first portion;

a striking ring mounted substantially transversely on the bag; and a base, wherein the bag includes a passage configured to slip over at least a portion of the base.

16. The training bag according to claim 3, wherein the kick post comprises a portion of the central support extending beyond the bottom of the lower portion and surrounded by a padded sleeve.

17. The training bag according to claim 1, wherein the kick post comprises wood or stuffing material surrounded by a cover and attached to the bottom of the lower portion.

18. A training bag, comprising:

a substantially cylindrical upper portion;

at least one connector attached to the upper portion and configured to suspend the bag;

a first head target extending from the upper portion;

a second head target positioned below the first head target and extending from the upper portion;

at least one arm extending from the upper portion between the first and second head targets;

a tapered lower portion depending from the upper portion;

a kick post depending from the lower portion; and a striking ring extending outwardly from the bag between the upper and lower portions.

19. The training bag according to claim 1, wherein the second head target is positioned below and opposite to the first head target and a pair of spaced apart arms located between the first and second head targets.

* * * * *